US005374007A

United States Patent [19]

Murison

[11] Patent Number: 5,374,007

[45] Date of Patent: Dec. 20, 1994

[54] RIBBON SUPPLY APPARATUS

[75] Inventor: Alexander S. Murison, Waterloo, Canada

[73] Assignee: NCR Corporation, Dayton, Ohio

[21] Appl. No.: 8,013

[22] Filed: Jan. 22, 1993

[51] Int. Cl.[5] ..... B65H 16/02

[52] U.S. Cl. ..... 242/538.2; 242/598.3; 242/599.1; 242/599.4; 242/609

[58] Field of Search ..... 242/67.3 R, 68.4, 68.5, 242/71.8, 538.2, 538.3, 598.3, 599.4, 599.1, 609

[56] References Cited

U.S. PATENT DOCUMENTS

| | | | |
|---|---|---|---|
| 3,281,090 | 10/1966 | Baranowski, Jr. | 242/67.3 R |
| 3,312,410 | 4/1967 | Strothmann | 242/67.3 R |
| 3,383,063 | 5/1968 | Balaban | 242/67.3 R |
| 3,721,398 | 3/1973 | Azzalin et al. | 242/67.3 R |
| 3,837,690 | 9/1974 | Fraser, Jr. et al. | 242/68.5 X |
| 3,893,636 | 7/1975 | Wise et al. | 242/67.3 R X |
| 3,997,125 | 12/1976 | Sato | 242/68.5 |
| 4,151,039 | 4/1979 | Lash | 242/67.3 R X |
| 4,316,759 | 2/1982 | Becker et al. | 242/67.3 R X |
| 4,651,943 | 3/1987 | Kawaguchi | 242/68.5 X |

*Primary Examiner*—Daniel P. Stodola

*Assistant Examiner*—Eileen A. Dunn

*Attorney, Agent, or Firm*—Elmer Wargo

[57] ABSTRACT

A ribbon supply apparatus including a support in which a ribbon supply spool and a take-up spool are rotatably mounted. The supply and take-up spools and the support are designed so that these spools can be mounted in the support in only one way, the correct way. The ribbon is supplied on a tubular core member which is mounted on a cylindrical member which is part of the supply spool. The ribbon supply spool has a large gear thereon which is used in a braking and feeding mechanism which is used to incrementally feed the ribbon to a print station associated with the apparatus. The ribbon take-up spool is identical to the ribbon supply spool, but the ribbon take-up spool is mounted in a reversed manner when compared to the ribbon supply spool. A driving gear, coupled to the large gear on the take-up spool is part of the braking and feeding mechanism which also includes a "dancer arm". The dancer arm controls a loop of ribbon which is fed to the print station. A metering roller is used in providing a predetermined amount of ribbon to the print station by enabling the take-up spool to pull ribbon from the loop of ribbon.

12 Claims, 4 Drawing Sheets

RIBBON SUPPLY APPARATUS

BACKGROUND OF THE INVENTION

1. Field of Invention

This invention relates to a ribbon supply apparatus for feeding ribbon to a print station and is directed to features which enable the ribbon supply spool and ribbon take-up spool to be mounted in the apparatus in only one way, that is, the correct way.

2. Background Information

A first general problem with handling ink ribbons is that they are messy to handle when the ribbon is to be changed for a printer, for example. A second problem with handling ribbons relates to those which are mounted on cores. With these core mounted ribbons, it is difficult to determine which way the core should be mounted on an associated spindle in order to have the end of the ribbon feed, as intended, from the "front or back" of the roll, for example, to the associated print station. Making sure that the ribbon is aligned, axially, on the associated spindle is also a problem.

SUMMARY OF THE INVENTION

An object of this invention is to provide a ribbon supply apparatus which ensures that a roll of ribbon will be properly mounted in the apparatus to be feed in the proper direction.

Another object of this invention is to provide a core for a supply of ribbon which core is used for both mounting the roll of ribbon thereon and for providing a driving coupling between the core and a driving or braking element used in an apparatus in which the ribbon is used.

In a first aspect of this invention, there is provided in a ribbon supply apparatus, a combination comprising:

a support including first and second side frames;

a ribbon supply spool having:

a cylindrical member having a large support portion near one end thereof and a small support portion near the remaining end of said cylindrical member;

said first and second side frames having first and second slots therein to receive, respectively, said large support portion and said small support portion therein to rotatably support said ribbon supply spool in said support; and a tubular core member having an open end and a partially closed end to enable said tubular core member to be mounted in only one direction on said cylindrical member prior to said ribbon supply spool being mounted in said support.

In a second aspect of this invention, there is provided a tubular core member for receiving a length of ribbon to be wound thereon;

said tubular core member having an open end, a partially closed end, and an inner surface, with said inner surface having teeth thereon near said closed end to enable said tubular core member to be mounted in only one direction on a cylindrical member and to enable the teeth on said tubular core member to mesh with complementary teeth on said cylindrical member.

The above advantages, and others, will be more readily understood in connection with the following specification, claims, and drawing.

DETAILED DESCRIPTION OF THE PREFERRED EMBODIMENT

Figure 1:
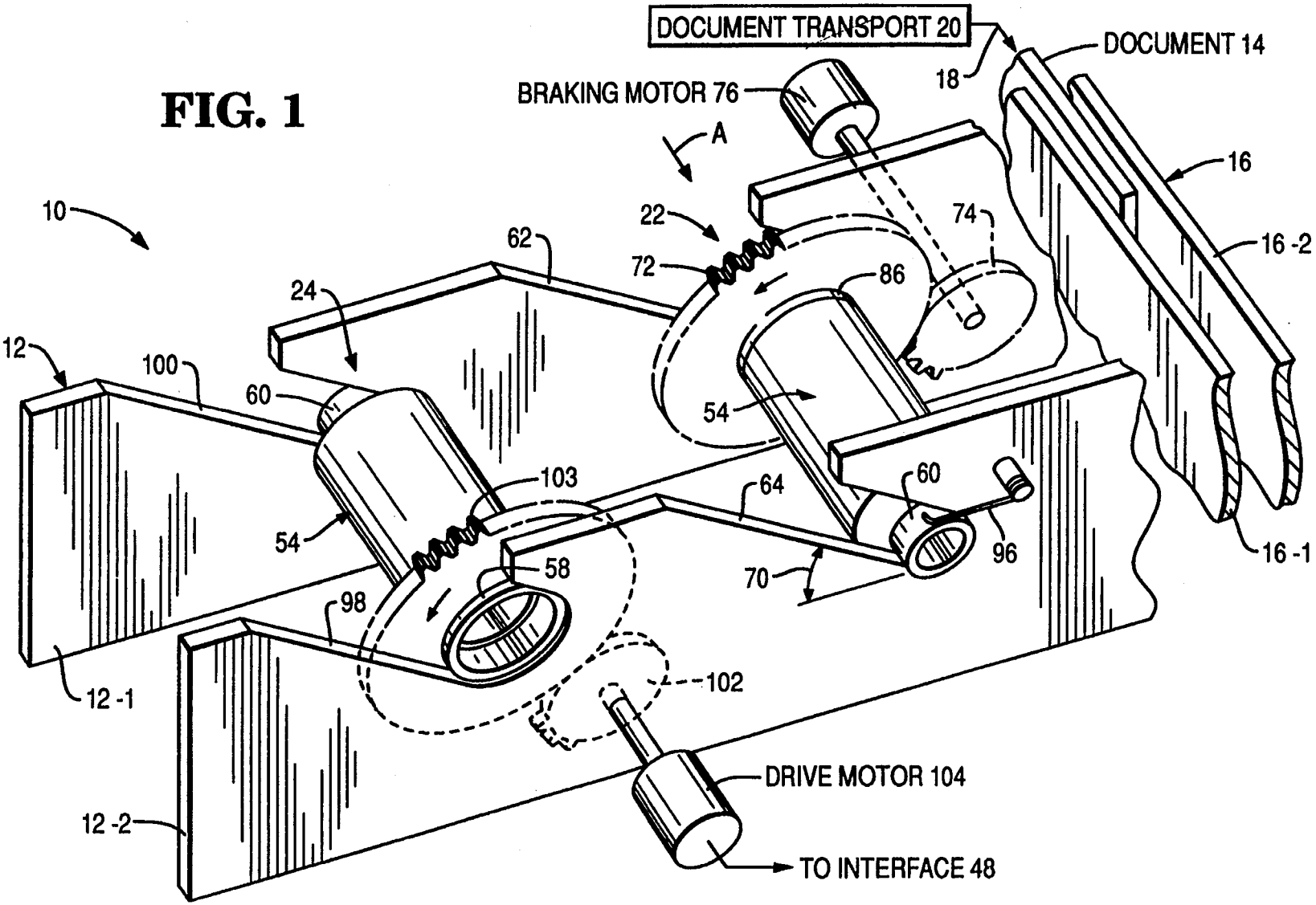
FIG. 1 is an isometric view of a ribbon supply apparatus made according to this invention, showing, among other elements, a ribbon supply spool and a ribbon take-up spool.

FIG. 1 shows a preferred embodiment of this invention which shows a ribbon supply apparatus which is designated generally as apparatus 10. The apparatus 10 includes a support 12 which includes first and second side frames 12-1 and 12-2. The apparatus 10 may be used in a business machine like an encoder which is used to print or encode data on a document 14. The document 14 is moved in a document track 16, in a downstream direction, as shown by the direction of arrow 18, by a document transport 20, as is done conventionally. The document track 16 has upstanding side walls 16-1 and 16-2 and a track bottom 16-3, as shown in FIG. 2.

Figure 2:
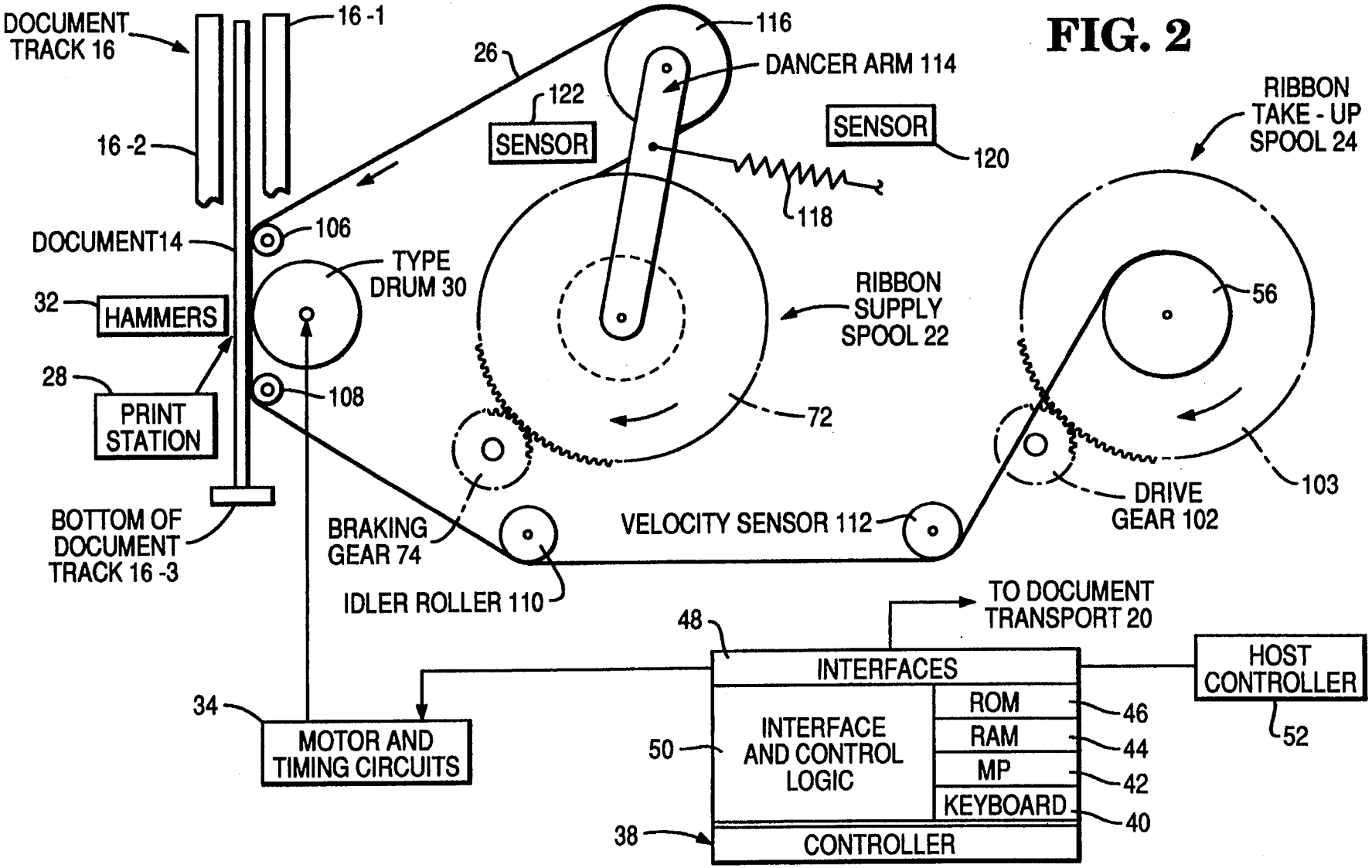
FIG. 2 is a schematic diagram, taken from the direction of arrow A of FIG. 2 to show additional elements of the apparatus shown in FIG. 1.
Figure 6:
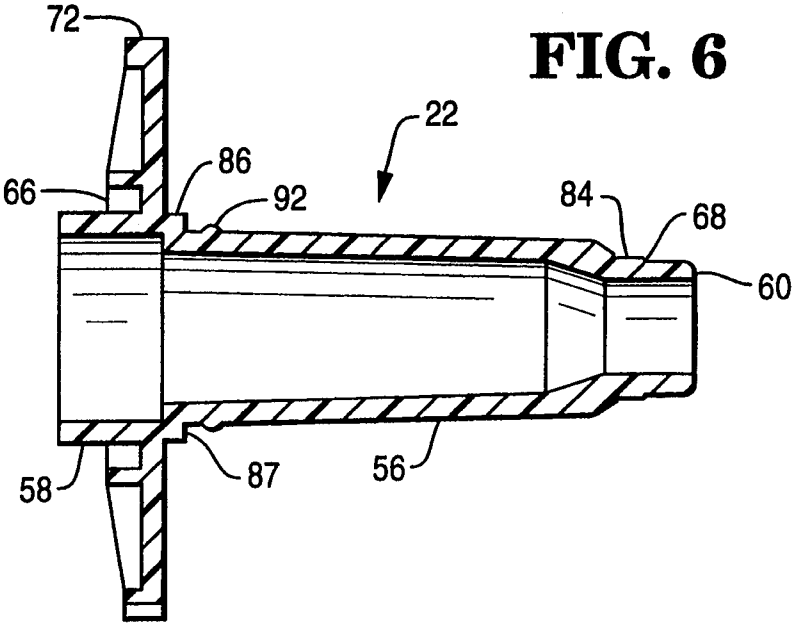
FIG. 6 is a cross sectional view of the ribbon supply spool shown in FIGS. 4 and 5, and is taken along the line 6—6 shown in FIG. 5.

FIGS. 1 and 2 are useful in explaining the general operation of the apparatus 10. The apparatus 10 includes a ribbon supply spool 22 and a ribbon take-up spool 24. Ribbon 26, from the supply spool 22 is fed to a print station 28 where a printer is used to print data on the document 14. In the embodiment described, the printer selected to portray the invention includes a type drum 30 and a plurality of hammers 32, although other types of printers, like thermal printers, could be used. The type drum 30 includes a plurality of type wheels, with one hammer 32 being provided for each type wheel included in the type drum 30. The upstanding sides 16-1 and 16-2 have suitable openings therein to enable the hammers 32 to impact the document 14 and the ribbon 26 against the type drum 30 as is conventionally done. There are the usual motor and timing circuits 34 to control the data which is printed on the document 14.

The apparatus 10 is controlled by a conventional controller 38 which has a keyboard (KB 40), microprocessor (MP 42), RAM 44, ROM 46, and interfaces 48 which are all intercoupled by interface and control logic 50. The interfaces 48 represent the various conventional interfaces which are necessary to couple the controller 38 to the various elements in the apparatus 10 and to a host controller 52 where necessary or desirable.

Figure 3:
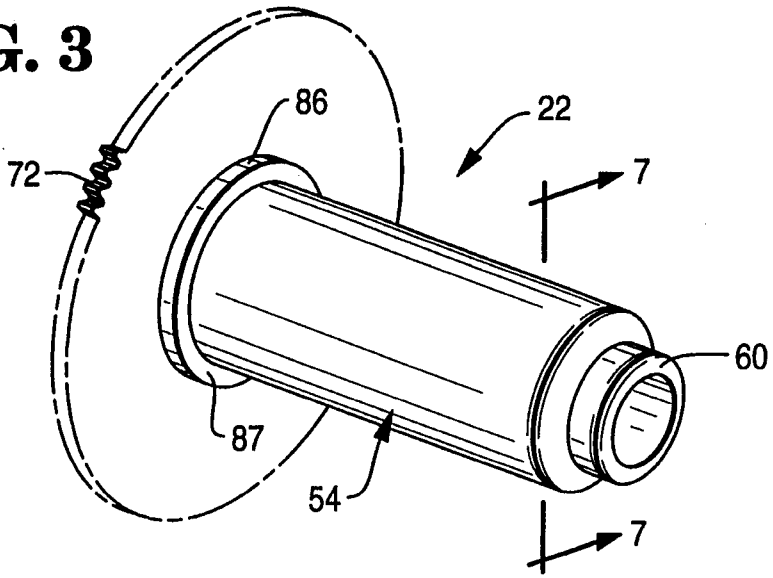
FIG. 3 is a general isometric view of the ribbon supply spool shown in FIG. 1, with a tubular core member thereon, but with the ribbon being removed from the supply spool.
Figure 8:
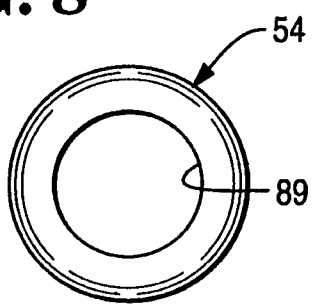
FIG. 8 is a right end view of the tubular core member shown in FIG. 7.
Figure 9:
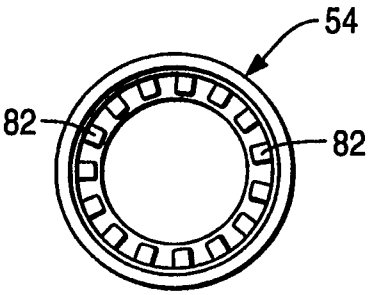
FIG. 9 is a left end view of the tubular core member shown in FIG. 7.

The ribbon supply spool 22, alluded to earlier herein, is shown in more detail in FIGS. 3, 4, 5, and 6. FIG. 3 shows the ribbon supply spool 22 with a tubular core member 54 being mounted thereon, with the tubular core member being shown in more detail in FIGS. 7, 8, and 9.

Figure 4:
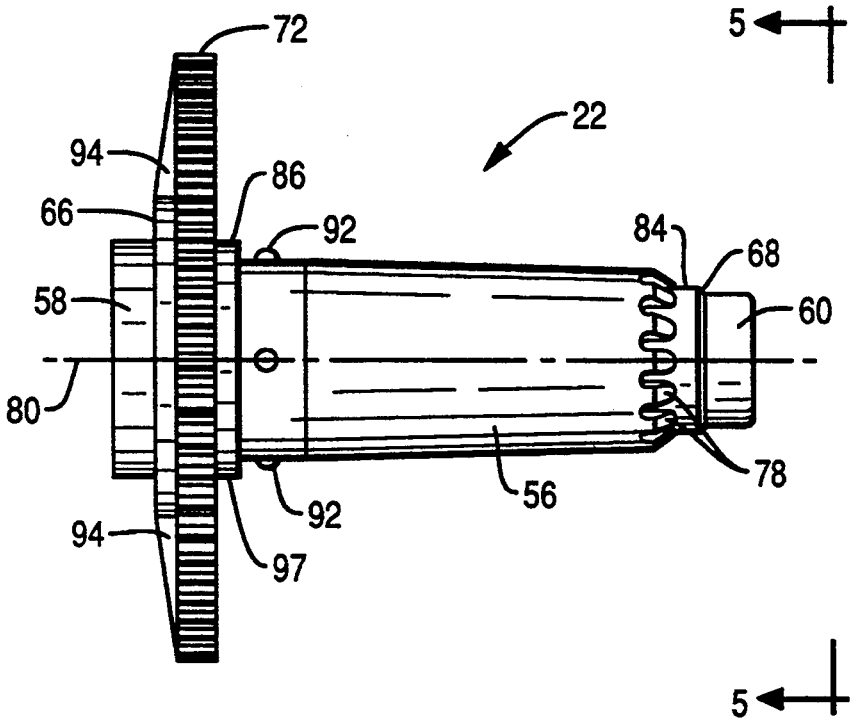
FIG. 4 is a side view, in elevation, of the ribbon supply spool shown in FIG. 3, with the tubular member being removed therefrom.
Figure 5:
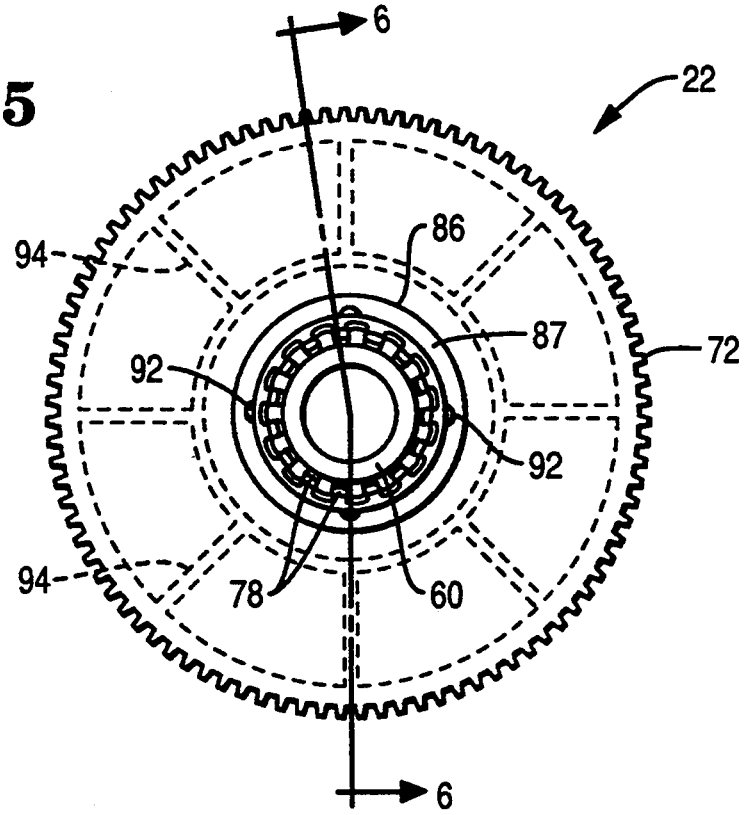
FIG. 5 is a right end view of the ribbon supply spool shown in FIG. 4.

The ribbon supply spool 22 has a generally cylindrical member 56 which has a large bearing or support portion 58 at one end thereof and a small bearing or support portion 60 at the remaining end thereof, as shown best in FIGS. 4 and 5. The first side frame 12-1 has a first slot or wide slot 62 (FIG. 1) to receive the large support portion 62 and also has a second or narrow slot 64 to receive the small support portion 60. This construction ensures that the ribbon supply spool 22 is loaded correctly in the support 12. The first and second side frames 12-1 and 12-2 are spaced apart so as to enable a shoulder 66 on the ribbon supply spool 22 to abut against the first side frame 12-1 and to enable an annular shoulder 68 near the small support portion 60 to abut against the second side frame 12-2 so as to restrain the ribbon supply spool 22 against axial movement within the support 12. The first and second slots 62 and 64 are positioned at an angle of 60 degrees relative to a horizontal line (as shown by double arrow 70 in FIG. 1); this type of construction enables the ribbon supply spool 22, with a supply of ribbon thereon, to be moved to its operating position shown in FIG. 1 without interfering with other elements in the machine in which the apparatus 10 is located. The ribbon which is used in the apparatus 10 is wound on the tubular core member 54 when received at the apparatus 10. The tubular core member 54 is positioned on the cylindrical member 56 of the ribbon supply reel 22 prior to moving the ribbon supply spool 22 into the position shown in FIG. 1.

Continuing with a description of the ribbon supply spool 22, shown in FIGS. 3–6, this construction also has an external gear 72 located near the large support portion 58. When the ribbon supply spool 22 is in the operating position shown in FIG. 1, the external gear 72 meshes with a braking gear 74. The braking gear 74 is coupled to a braking motor 76, which is controlled by the controller 38, as will be described hereinafter. Essentially, the breaking gear 74 and the braking motor 76 keep the ribbon supply spool 22 from rotating.

As seen from FIG. 4, the generally cylindrical member 56 of the ribbon supply spool 22 is slightly tapered, being narrower at the end containing the small support portion 60. This construction facilitates the fabrication of the ribbon supply spool 22 and also facilitates the loading of the tubular core member 54, with the ribbon 26 thereon, on to the cylindrical member 56. The cylindrical member 56 also has a plurality of teeth 78 thereon, with these teeth 78 being aligned parallel to the longitudinal axis 80 of the ribbon supply spool 22. In the embodiment described, the plurality of teeth 78 are spaced 24 degrees apart. These external teeth 78 mesh with complementary teeth 82 located near a partially closed end 84 of the tubular core member 54, as shown best in FIG. 9. The teeth 82 are also spaced 24 degrees apart. One of the features of this invention is that because there are 24 teeth 78 (a large number) on the cylindrical member 56 and a matching number on the tubular core member 54, these two members do not have to be rotated very far, relative to each other, to enable the teeth 78 and 82 to mesh with one another and to enable the tubular core member 54, with the ribbon thereon, to be mounted on the ribbon supply spool 22. The ribbon supply spool 22 also has an annular bearing surface 84 (FIG. 4) which is located in an annular recess 89 (FIG. 7) of the tubular core member 54 when these two members are coupled together as previously described. The ribbon supply spool 22 also has an annular shoulder 86 with an annular face 87 against which the open end 88 (FIG. 7) of the tubular core member abuts when in the assembled relationship shown in FIG. 1.

Figure 7:
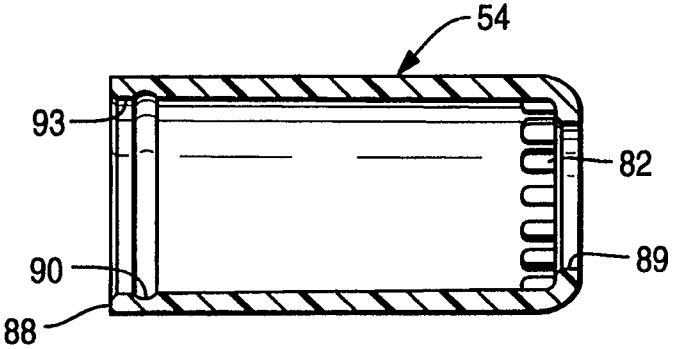
FIG. 7 is a cross sectional view of the tubular core member shown in FIG. 3, with this view being taken along the line 7—7 of FIG. 3.

The tubular core member 54 has an annular recess 90 therein and an annular detent 92 as shown in FIG. 7. The ribbon supply spool 22 has several projections, like 92 shown in FIG. 4, positioned around the circumference of the cylindrical member 56 to cooperate with the annular detent 93 to detachably hold the tubular core member 54 on the cylindrical member 56.

The ribbon supply spool 22 also has some radially aligned stiffeners or ribs 94 which provide strength thereto. In the embodiment described, the ribbon supply spool 22 is made of a plastic material, like nylon 6/6 with 20% PTFE; this material is self lubricating. The tubular core member 54 is made of ABS, a plastic material Naturally, the bottoms of the slots 62 and 64, shown in FIG. 1, are arcuately shaped to rotatably support the large support portion 58 and the small support portion 60 and to maintain the longitudinal axis 80 of the ribbon supply spool 22 in a horizontal position in the embodiment described. The ribbon supply spool 22, with a supply of ribbon 26 thereon, is maintained in the position shown in FIG. 1 by gravity and a spring clip which is shown, schematically, as a spring loaded wire 96. The wire 96 biases the ribbon supply spool 22 in a downward direction, as viewed in FIG. 1. The wire 96 contacts the support portion 60 of the ribbon supply spool 22. There is a similar spring loaded wire 96 (not shown) contacting the support portion 58 of the ribbon supply spool 22. The ribbon take-up spool 24 has similar spring loaded wires 96 support portions 58 and 60.

While this discussion has proceeded with respect to the ribbon supply spool 22, the ribbon take-up spool 24 is identical to the ribbon supply spool 22; consequently, a detailed discussion of the take-up spool 24 is not deemed necessary. An important difference relates to the way that the ribbon take-up spool 24 is positioned in the support 12. In this regard, the large support portion 58 of the take-up spool 24 is mounted in a slot 98 in the second side frame 12-2 and the small support portion 60 is mounted in a slot in the side frame 12-1, as shown in FIG. 1. The external gear 103 of the take-up spool 24 is in mesh with a driving gear 102 which is rotated by a drive motor 104 which is controlled by the controller 38. The external gears 72 and 103 of the ribbon supply spool 22 and the ribbon take-up spool 24 are located on opposed sides of the support 12 when properly positioned in the support 12 as shown in FIG. 1.

FIG. 2 is a schematic diagram showing how the ribbon supply apparatus works. In this regard, the ribbon 26 is wound on the tubular core member 54 so that the ribbon 26 unwinds from the ribbon supply spool 22 in the direction shown in FIG. 2. The ribbon 26 rides over rollers 106 and 108 at the print station 28 to provide some clearance for the type drum 30 to rotate without contacting the ribbon 26 until actual printing takes place by energizing the print hammers 32. An idler roller 110 is used to route the ribbon 26 from the print station 28 to a metering roller 112, and thereafter, the ribbon 26 is wound on the tubular core member 56 of the take-up spool 24 in the direction shown. The general function of the metering roller 112 is to cooperate with the drive motor 104 to ensure that a prescribed amount of ribbon 26 is supplied to the print station 28 for each cycle of printing which is effected. Because this aspect is not important to an understanding of this invention, it need not be discussed in any further detail.

The overall operation of the ribbon supply apparatus 10 is as follows. The apparatus 10 includes a dancer arm 114 which has one end pivotally mounted in the support 12 and the remaining end thereof pivotally supporting a roller 116 as shown. The roller 116 has an axial length which supports the entire width of the ribbon 26. The dancer arm is biased in a clockwise direction, as viewed in FIG. 2, by a tension spring 118. When a fresh supply of ribbon 26 is to be supplied to the print station 28, the controller 38, through its associated software stored in the ROM 46 or RAM 44, will "unlock" the braking motor 76, permitting the dancer arm 114 to be pivoted in a clockwise direction (by the spring 118) to unwind some ribbon 26 from the ribbon supply spool 22. As the dancer arm 114 pivots in a clockwise direction (FIG. 1), it approaches a positional sensor 120 which is coupled to the controller 38 via the interfaces 48, and the controller 38 actuates the braking motor 76 which prevents further rotation of the ribbon supply spool 22. Thereafter, the controller 38 energizes the drive motor 104 to feed the necessary amount of ribbon 26 to the print station 28 as required by the printing demands. As the ribbon 26 is fed to the print station 28, the dancer arm 114 pivots in a counterclockwise direction against the bias of the tension spring 118 until the dancer arm 114 approaches a positional sensor 122 which is coupled to the controller 38 via the interfaces 48. The controller 38 then deenergizes the braking motor 76, permitting the tension spring 118 to withdraw a new length of ribbon 26 as described.

When the ribbon 26 from the supply spool 22 is exhausted, the supply spool 22 is removed from the position shown in FIG. 1, and the empty tubular core member 54 is removed therefrom. A new tubular core member 54, with a new supply of ribbon thereon, is inserted on the ribbon supply spool 22 as previously explained. The used ribbon 26 is then removed from the ribbon take-up spool 24, and the "empty" tubular core member 54 from the ribbon supply spool 22 is then mounted on the ribbon takeup spool 24, and this spool 24 is then mounted in the apparatus 10. The core member 54 may be made of different colored plastic to indicate the type of ribbon wound thereon.

What is claimed is:

1. In a ribbon supply apparatus, a combination comprising:

a support including first and second side frames;

a ribbon supply spool having:

a cylindrical member having a large support portion near one end thereof and a small support portion smaller than said large support portion near the remaining end of said cylindrical member;

said first and second side frames having first and second slots therein to receive, respectively, said large support portion and said small support portion therein to rotatably support said ribbon supply spool in said support, with said first slot being located in said first side frame and said second slot being located in said second side frame; and a tubular core member having an open end and a partially closed end to enable said tubular core member to be mounted in only one direction on said cylindrical member prior to said ribbon supply spool being mounted in said support.

2. The combination as claimed in claim 1 in which said cylindrical member has external driving teeth near said remaining end and said tubular core member has internal driving teeth near said closed end to mesh with said external driving teeth when said tubular core member is mounted on said cylindrical member to form a driving coupling therebetween.

3. The combination as claimed in claim 2 in which said cylindrical member has an external gear fixed thereto near said large support portion for coupling to a braking gear.

4. In a ribbon supply apparatus, a combination comprising:

a support including first and second side frames;

a ribbon supply spool having:

a cylindrical member having a large support portion near one end thereof and a small support portion smaller than said large support portion near the remaining end of said cylindrical member;

said first and second side frames having first and second slots therein to receive, respectively, said large support portion and said small support portion therein to rotatably support said ribbon supply spool in said support; and a tubular core member having an open end and a partially closed end to enable said tubular core member to be mounted in only one direction on said cylindrical member prior to said ribbon supply spool being mounted in said support;

a ribbon take-up spool having:

a cylindrical member having a large support portion near one end thereof and a small support portion smaller than said large support portion near the remaining end of said cylindrical member;

said first and second side frames having third and fourth slots therein to receive, respectively, said large support portion and said small support portion of said ribbon take-up spool therein to rotatably support said ribbon take-up spool in said support; and a tubular core member having an open end and a partially closed end to enable said tubular core member to be mounted in only one direction on said cylindrical member of said ribbon take-up spool prior to said ribbon take-up spool being mounted in said support; and said ribbon supply spool and said ribbon take-up spool being identical in construction.

5. The combination as claimed in claim 4 in which said cylindrical member of said ribbon supply spool has external driving teeth near said remaining end and said tubular core member of said ribbon supply spool has internal driving teeth near said closed end to mesh with said external driving teeth when said tubular core member is mounted on said cylindrical member of said ribbon supply spool to form a driving coupling therebetween.

6. The combination as claimed in claim 5 in which the associated cylindrical member of said ribbon supply spool and said ribbon take-up spool has an external gear fixed thereto near the associated large support portion.

7. The combination as claimed in claim 6 in which said ribbon supply spool and said ribbon take-up spool are identical.

8. The combination as claimed in claim 7 in which said first and said third slots have the same width and in which said second and fourth slots have the same width to enable said ribbon supply reel and said ribbon take-up reel to be mounted in only one direction in said support.

9. The combination as claimed in claim 8 in which said first, second, third, and fourth slots are aligned at an acute angle relative to a horizontal line.

10. A tubular core member for receiving a length of ribbon to be wound thereon, said tubular core member adapted to be mounted on a generally cylindrical support member having a large support portion near one end thereof and a small support portion near the remaining end of said support member, with said small support portion being smaller than said large support portion;

said tubular core member having an inner surface, an outer surface for receiving said ribbon, an open end, and a partially closed end, with said partially closed end having an opening therein, with said opening in said partially closed end being concentric with said open end, and with said opening being dimensioned to receive said small support portion when said tubular core member is mounted on said cylindrical support member;

said tubular core member having an annular recess on the inside surface thereof near said open end, with said annular recess cooperating with a detent member on said large support portion of said cylindrical support member to detachably retain said tubular core member on said cylindrical support member when said tubular core member is mounted thereon; and said inner surface of said tubular core member having teeth thereon near said partially closed end, which said partially closed end enables said tubular core member to be mounted in only one direction on said cylindrical support member, to enable the teeth to mesh with complementary teeth on said cylindrical support member.

11. A combination of a tubular core member and a length of ribbon wound thereon, said tubular core member adopted to be mounted on a generally cylindrical support member having a large support portion near one end thereof and a small support portion smaller than said large support portion near the remaining end of said cylindrical support member, with said small support portion being smaller than said large support port ion;

said tubular core member having an inner surface, an outer surface for receiving said ribbon, an open end, and a partially closed end, with said partially closed end having an opening therein, with said opening in said partially closed end being concentric with said open end, and with said opening being dimensioned to receive said small support portion when said tubular core member is mounted on said cylindrical support member;

said tubular core member having an annular recess on the inside surface thereof near said open end, with said annular recess cooperating with a detent member on said large support portion of said cylindrical support member to detachably retain said tubular core member on said cylindrical support member when said tubular core member is mounted thereon; and said inner surface of said tubular core member having teeth thereon near said partially closed end, which said partially closed end enables said tubular core member to be mounted in only one direction on said cylindrical support member, to enable the teeth to mesh with complementary teeth on said cylindrical support member.

12. In a ribbon supply apparatus, a combination comprising:

a support including first and second side frames;

a ribbon supply spool having:

a cylindrical support member having a large support portion near one end thereof and a small support portion smaller than said large support portion near the remaining end of said cylindrical member;

said first and second side frames having first and second slots therein to receive, respectively, said large support portion and said small support portion therein to rotatably support said ribbon supply spool in said support, and a tubular core member;

said tubular core member having an inner surface, an outer surface for receiving a length of ribbon, an open end, and a partially closed end, with said partially closed end having an opening therein, with said opening in said partially closed end being concentric with said open end, and with said opening being dimensioned to receive said small support portion when said tubular support member is mounted on said cylindrical support member;

said tubular core member having an annular recess on the inside surface thereof near said open end, with said annular recess cooperating with a detent member on said large support portion of said cylindrical support member to detachably retain said tubular core member on said cylindrical support member when said tubular core member is mounted thereon; and said inner surface of said tubular core member having teeth thereon near said partially closed end, which said partially closed end enables said tubular core member to be mounted in only one direction on said cylindrical support member, to enable the teeth to mesh with complementary teeth on said cylindrical support member.

* * * * *

UNITED STATES PATENT AND TRADEMARK OFFICE

CERTIFICATE OF CORRECTION

PATENT NO. : 5,374,007

DATED : December 20, 1994

INVENTOR(S) : Alexander S. Murison

It is certified that error appears in the above-indentified patent and that said Letters Patent is hereby corrected as shown below:

Column 7, line 39, "adopted" should be --adapted--.

Column 7, line 45, "port ion" should be --portion--.

Signed and Sealed this

Eleventh Day of April, 1995

Bruce Lehman

*Attest:*

BRUCE LEHMAN

*Attesting Officer*

*Commissioner of Patents and Trademarks*